US008844208B1

(12) United States Patent
Feldhaus

(10) Patent No.: US 8,844,208 B1
(45) Date of Patent: Sep. 30, 2014

(54) RAIN CATCHING AND SCREENING ASSEMBLY

(71) Applicant: Phil Feldhaus, Demotte, IN (US)

(72) Inventor: Phil Feldhaus, Demotte, IN (US)

( * ) Notice: Subject to any disclaimer, the term of this patent is extended or adjusted under 35 U.S.C. 154(b) by 0 days.

(21) Appl. No.: 14/277,009

(22) Filed: May 13, 2014

Related U.S. Application Data

(63) Continuation-in-part of application No. 14/091,089, filed on Nov. 26, 2013, now Pat. No. 8,720,122, which is a continuation-in-part of application No. 13/495,361, filed on Jun. 13, 2012, now Pat. No. 8,595,985.

(60) Provisional application No. 61/496,193, filed on Jun. 13, 2011.

(51) Int. Cl.
*E04D 13/00* (2006.01)
*E04D 13/076* (2006.01)

(52) U.S. Cl.
CPC ..... *E04D 13/076* (2013.01)
USPC ..... 52/12

(58) Field of Classification Search
CPC ... E04D 13/076; E04D 13/064; E04D 13/158; E04D 13/0643; E04D 13/0725; E04D 13/072
USPC ..... 52/11–16; 248/48.1, 48.2
See application file for complete search history.

(56) References Cited

U.S. PATENT DOCUMENTS

| | | | | | |
|---|---|---|---|---|---|
| 453,948 | A * | 6/1891 | Smith et al. | 52/12 |
| 474,442 | A * | 5/1892 | Byers et al. | 210/477 |
| 1,308,311 | A * | 7/1919 | Ward | 52/12 |
| 2,734,467 | A * | 2/1956 | Steele | 52/12 |
| 3,295,264 | A * | 1/1967 | Olson | 52/12 |
| 4,907,381 | A * | 3/1990 | Ealer | 52/12 |
| 4,941,299 | A * | 7/1990 | Sweers | 52/12 |
| 4,959,932 | A * | 10/1990 | Pfeifer | 52/12 |
| 4,965,969 | A * | 10/1990 | Antenen | 52/12 |
| 5,044,581 | A * | 9/1991 | Dressler | 248/48.1 |
| 5,056,276 | A * | 10/1991 | Nielsen et al. | 52/12 |
| 5,109,640 | A * | 5/1992 | Creson | 52/12 |
| 5,271,192 | A * | 12/1993 | Nothum et al. | 52/12 |
| 5,321,920 | A * | 6/1994 | Sichel | 52/12 |
| 5,406,754 | A * | 4/1995 | Cosby | 52/12 |
| 5,555,681 | A * | 9/1996 | Cawthon | 52/63 |
| 5,611,175 | A * | 3/1997 | Sweers | 52/12 |
| 5,842,311 | A * | 12/1998 | Morin | 52/12 |
| 5,848,857 | A * | 12/1998 | Killworth et al. | 405/118 |
| 6,282,845 | B1 * | 9/2001 | Hines | 52/12 |
| 6,349,506 | B1 * | 2/2002 | Pace et al. | 52/12 |

(Continued)

*Primary Examiner* — Mark Wendell
*Assistant Examiner* — Keith Minter
(74) *Attorney, Agent, or Firm* — Patent Law & Venture Group; Gene Scott

(57) ABSTRACT

A rain catching and screening assembly is fixed in place along a roof line of a building at adjoining roof portions, where the portions meet at an approximate right angle thereby forming a concave V-shaped roof valley. The assembly includes a rain gutter and plural gutter screens. The gutter has portions joined at a right angle adjacent to the roof valley. The screens terminate at an outer gutter lip and extend up onto the roof portions where they are wedged between roof shingles or tiles. One of the gutter screens is positioned over the two adjoining roof portions, and has a V-shaped crease in the mesh layer and fine screening layer thereby lying in contact with the adjoining roof portions in alignment with the V-shaped roof valley.

9 Claims, 4 Drawing Sheets

(56) References Cited

U.S. PATENT DOCUMENTS

| | | | | |
|---|---|---|---|---|
| 6,463,700 | B2 * | 10/2002 | Davis | 52/12 |
| 6,735,907 | B2 * | 5/2004 | Stevens | 52/12 |
| 6,932,901 | B2 * | 8/2005 | Crosby | 210/162 |
| 6,951,077 | B1 * | 10/2005 | Higginbotham | 52/12 |
| 7,174,688 | B2 * | 2/2007 | Higginbotham | 52/672 |
| 7,198,714 | B2 * | 4/2007 | Swistun | 210/162 |
| D551,740 | S * | 9/2007 | Riley | D23/267 |
| 7,303,687 | B2 * | 12/2007 | Groth et al. | 52/12 |
| 7,310,912 | B2 * | 12/2007 | Lenney et al. | 52/12 |
| 7,614,185 | B2 * | 11/2009 | Brochu | 52/11 |
| 7,627,991 | B1 * | 12/2009 | Feldhaus | 52/12 |
| 7,793,465 | B2 * | 9/2010 | McCann | 52/12 |
| 8,006,438 | B2 * | 8/2011 | Higginbotham | 52/12 |
| RE42,896 | E * | 11/2011 | Higginbotham | 52/12 |
| 8,069,617 | B2 * | 12/2011 | Wootton | 52/12 |
| 8,312,677 | B2 * | 11/2012 | Higginbotham | 52/12 |
| 2004/0262207 | A1 * | 12/2004 | Crosby | 210/162 |
| 2005/0102909 | A1 * | 5/2005 | Carpenter et al. | 52/11 |
| 2005/0155919 | A1 * | 7/2005 | Swistun | 210/155 |
| 2005/0155920 | A1 * | 7/2005 | Swistun | 210/162 |
| 2006/0053697 | A1 * | 3/2006 | Higginbotham | 52/12 |
| 2006/0070304 | A1 * | 4/2006 | Barnett | 52/11 |
| 2006/0107603 | A1 * | 5/2006 | Brownridge | 52/11 |
| 2006/0117670 | A1 * | 6/2006 | Tsioris | 52/11 |
| 2006/0163129 | A1 * | 7/2006 | Swistun | 210/162 |
| 2006/0179723 | A1 * | 8/2006 | Robins | 52/11 |
| 2006/0201068 | A1 * | 9/2006 | Shane | 52/11 |
| 2006/0230687 | A1 * | 10/2006 | Ealer, Sr. | 52/12 |
| 2006/0265968 | A1 * | 11/2006 | Lowrie, III | 52/11 |
| 2007/0107323 | A1 * | 5/2007 | Higginbotham | 52/120 |
| 2007/0204521 | A1 * | 9/2007 | Jackson et al. | 52/11 |
| 2008/0289263 | A1 * | 11/2008 | Brochu | 52/12 |
| 2009/0056234 | A1 * | 3/2009 | Brochu | 52/12 |
| 2009/0107053 | A1 * | 4/2009 | Guilford | 52/12 |
| 2009/0188172 | A1 * | 7/2009 | DuCharme et al. | 52/11 |
| 2009/0300995 | A1 * | 12/2009 | Nikolopoulos | 52/12 |
| 2010/0088971 | A1 * | 4/2010 | Horton | 52/12 |
| 2011/0056145 | A1 * | 3/2011 | Lenney et al. | 52/12 |
| 2011/0067318 | A1 * | 3/2011 | Lenney et al. | 52/12 |
| 2011/0083375 | A1 * | 4/2011 | Tenute | 52/11 |
| 2011/0138697 | A1 * | 6/2011 | Martin | 52/12 |
| 2011/0162289 | A1 * | 7/2011 | Cangialosi | 52/12 |
| 2011/0185641 | A1 * | 8/2011 | Snell | 52/12 |
| 2011/0225898 | A1 * | 9/2011 | Iannelli | 52/12 |
| 2011/0265390 | A1 * | 11/2011 | Brochu | 52/12 |
| 2011/0272344 | A1 * | 11/2011 | Higginbotham | 210/494.1 |
| 2011/0283630 | A1 * | 11/2011 | Beckham et al. | 52/12 |
| 2012/0047817 | A1 * | 3/2012 | Prentice | 52/11 |
| 2012/0159868 | A1 * | 6/2012 | Lenney et al. | 52/12 |

* cited by examiner

RAIN CATCHING AND SCREENING ASSEMBLY

In full or in part, this application describes the same apparatus and method as presented in co-pending non-provisional application Ser. No. 14/091,089, filed on Nov. 26, 2013, and claims international date priority thereof as a Continuation-In-Part application. The subject matter of application Ser. No. 14/091,089 is hereby incorporated herein by reference in its entirety.

BACKGROUND

The present disclosure relates to rain gutters and their screens which are normally fixed in place over roof rain gutters to prevent the entry of debris such as: leaves, twigs, branches, flowers, seed pods, pine needles, and other objects into the rain gutters. Such debris is known to clog gutters and their drains. This disclosure relates to such gutter screens and particularly screens that are used for gutters mounted on peaked roofs where a significant amount of debris is known to collect, that is, where gutters meet at a right angle or at a near right angle and adjacent peaked roof sections meet forming a V-shaped valley. In such locations a greater flow of rain runoff occurs and typically more debris is washed down to the gutter than at other peaked roof locations. This has been known to be a serious problem as debris can build up on or near gutters causing water pooling and back flow under shingles and tiles resulting in roof leaks, mold and mildew growth, degradation of roof sheeting, and other problems. Roof gutters are typically U-shaped with an open top into which rain water flows from a roof surface. Gutter screens are generally placed on the open top against the opposing upper lip surfaces of the gutter and are thus laid flat and horizontal. In this arrangement, the gutter screens are most often screwed down to the gutter lips. For roofs covered by singles or flat tiles the outer edge of the screen may be screwed down to the outer gutter lip while the opposing (inner) edge of the screen may be wedged between adjacent shingles or tiles. This has advantages including preventing debris from wedging between the gutter and the edge of the roof and also making screen installation quicker and easier. After a number of years of manufacturing and installing gutter screens on many configurations of residential and commercial buildings, and experimenting with many types and kinds of gutter screen types, an ideal gutter screen assembly has been developed which is believed to be superior to those described in the prior art. The ideal gutter screen assembly is herein disclosed.

BRIEF DESCRIPTION OF THE DRAWINGS

Like reference symbols in the drawing figures indicate like elements.

DETAILED DESCRIPTION

Figure 1:
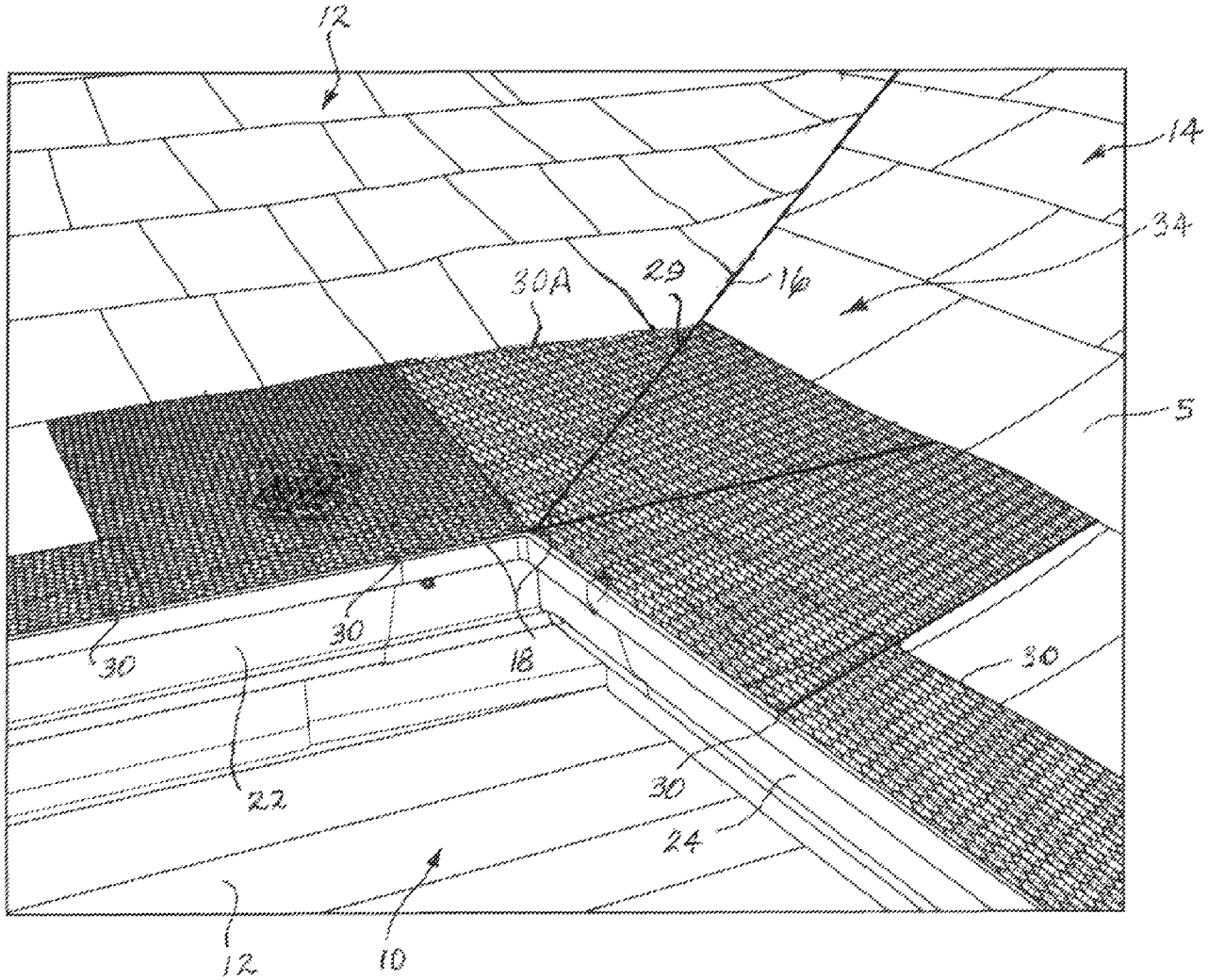
FIG. 1 is an example perspective view of a portion of a roof having two roof portions meeting at a right angle and showing a gutter attached at a right angle and having gutter screens covering the gutter.

As shown in FIG. 1, a peaked roof building 10 may have adjoining roof portions 12, 14, said portions meeting at an approximate right angle thereby forming a concave V-shaped roof valley 16. A rain catching and screening assembly 15 (FIGS. 2 and 3) may include a rain gutter 22 and 24 and plural gutter screens 30 and may be attached to building 10 along its roof line 18 as is well known in the art. Rain gutter 22, 24 may form an approximate right angle (angle $\alpha$) between a first 22 and a second 24 gutter portions (FIG. 2), the gutter portions joined at a position in line with roof valley 16 as clearly shown in FIG. 1. Gutter portions 22, 24 each may have a generally U-shaped cross section shape as shown in FIG. 4 thereby defining an outer gutter leg 25 terminating at an outer gutter lip 26, and an inner gutter leg 27 terminating at an inner gutter lip 28, inner gutter leg 27 fastened to the building 10 approximately parallel to, and under roof line 18, where roof line is the edge of roof portions 12, 14 as known in the art. Screens 30, each may be rectangular in shape with a peripheral edge 32 extending fully around the outside of the screen, a top surface 34 shown in FIG. 1, a bottom surface 36 shown in FIGS. 2 and 3, a structural mesh layer 37 and a fine screening layer 38. Screens 30 may be arranged in side-by-side positions overcasting rain gutter 20 and a portion of the roof portions 12, 14, the peripheral edge 32 of screens 30 may be fastened to the outer gutter lip 26 by common hardware, for instance, and in an opposing position, edge 32 may be wedged, as shown in FIG. 1, between roofing materials 40 of roof portions 12, 14, e.g., roof shingles, tiles or other roofing materials or features.

In embodiments, one of gutter screens 30A in FIG. 1, may be positioned over, that is, bridging the two adjoining roof portions 12, 14, and may have a V-shaped crease 29 in the mesh layer 37 and fine screening layer 38 thereby enabling it to lie in contact with the adjoining roof portions 12, 14 in alignment with roof valley 16. This is an important and novel aspect of the disclosed apparatus.

Figure 2:
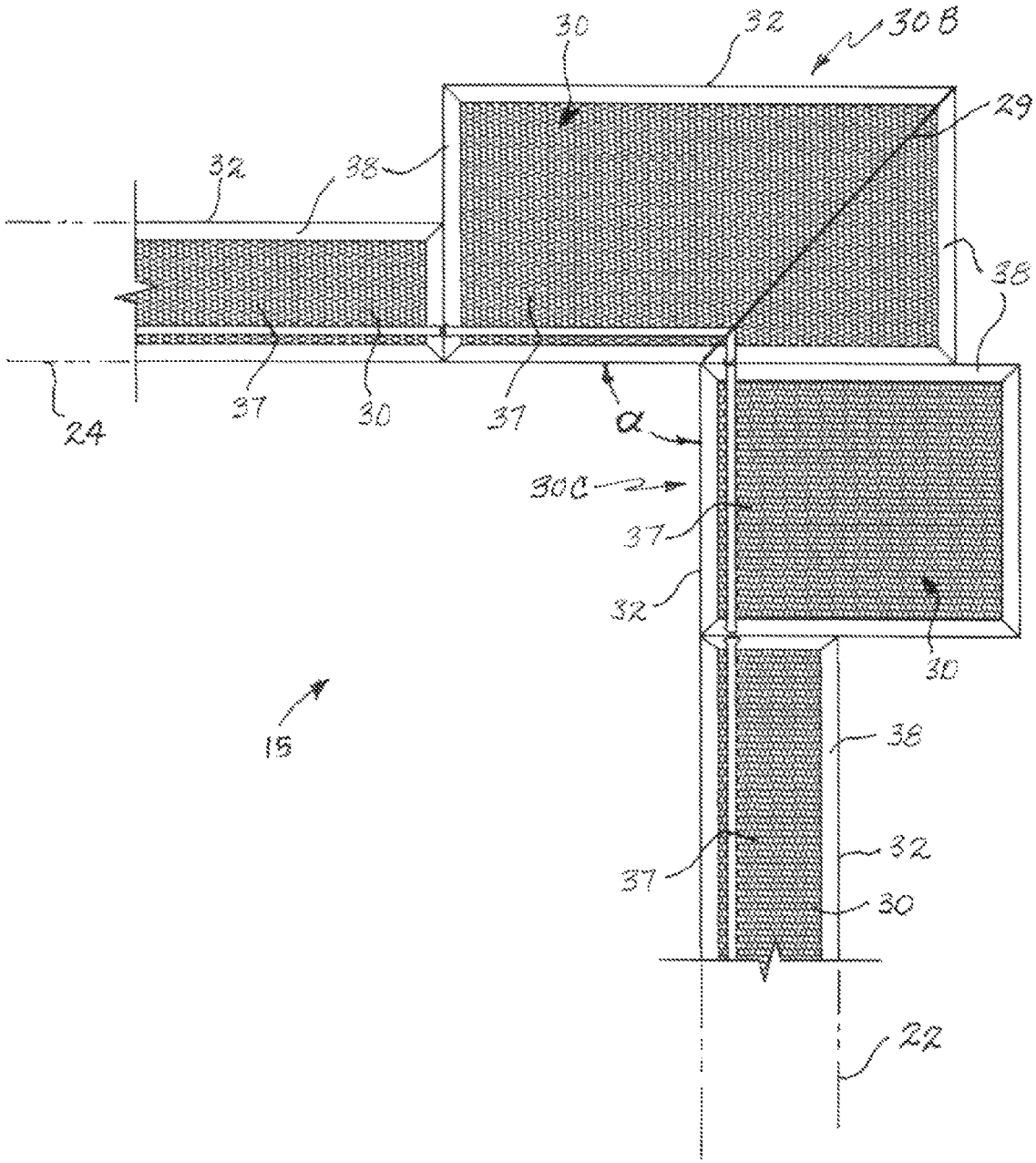
FIG. 2 is an example bottom plan view of a set of gutter screen sections as arranged for mounting on the roof, a white border around the periphery of the screens represents a hem of a fine screening material as folded around the edges of the gutter screen.

In embodiments, the plural gutter screens in the vicinity of the roof valley 16 may include two gutter screens as shown in FIG. 2, wherein one of the screens 30B may have a length of approximately 21 inches and a width of approximately 12 inches and a second one of the gutter screens 30C may have a length of approximately 11 inches and a width of approximately 12 inches. It has been found that the stated screen outside dimensions enable screens 30B and 30C to fit within roof valley 16 advantageously so as to achieve gutter and shingle securement in most contemporary roof coverings with their typical installation variations, i.e., spacing of shingles, tiles, etc. It has been found that screen width dimensions significantly smaller or larger than 12 inches do not reach, or over-reach shingles or tiles in the majority of roof constructions or do not wedge properly between such roofing elements. Note: the "width" of screens 30 as defined herein is as measured from gutter 22 or 24 toward the roof peak while the "length" as defined herein is as measured along the roof line 18.

Figure 3:
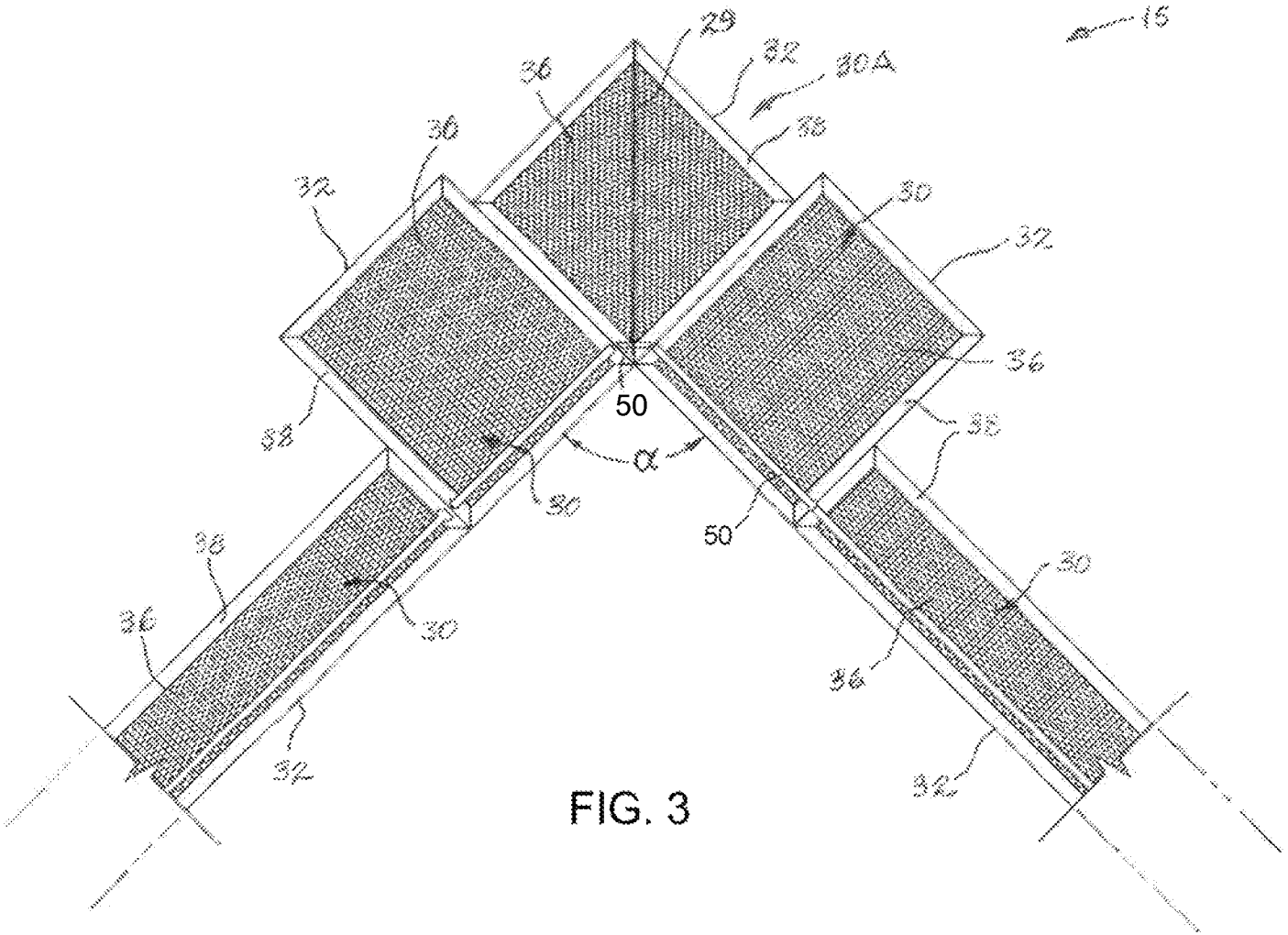
FIG. 3 is an example bottom plan view of a further set of gutter screen sections as arranged for mounting on the roof, a white border around the periphery of the screens represents a hem of a fine screening material as folded around the edges of the gutter screen.
Figure 4:
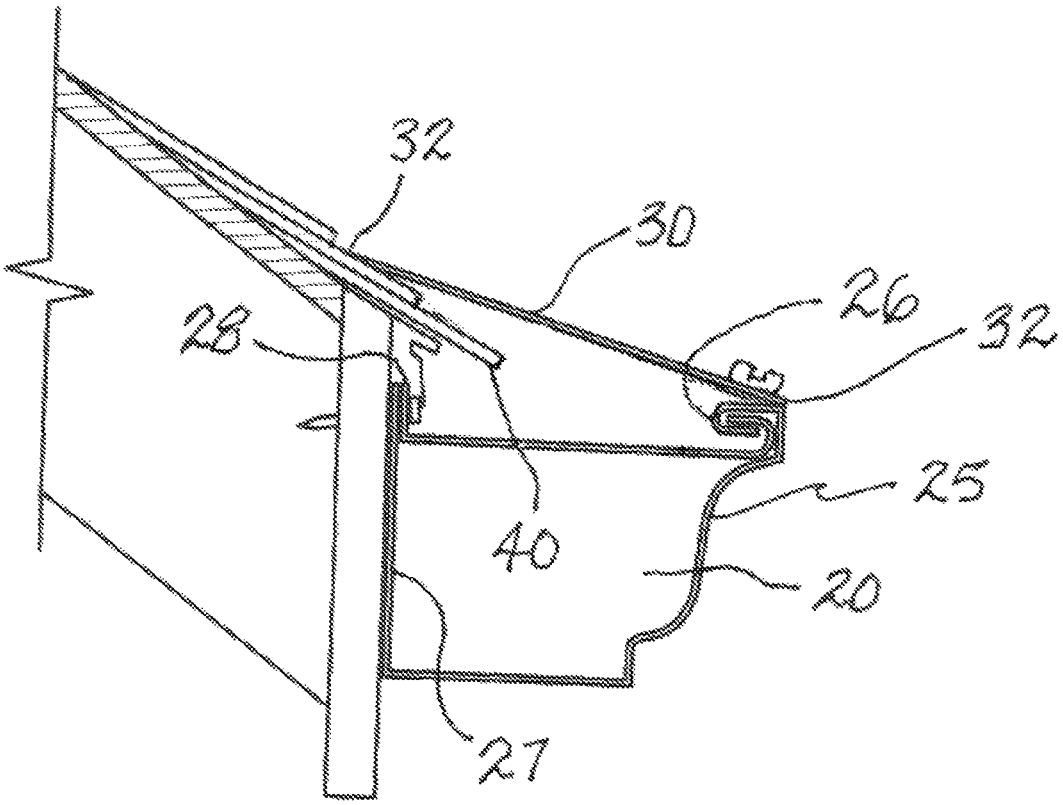
FIG. 4 is an example of a side elevation view of a rain gutter as mounted on a building at the roof line and showing a gutter screen extending between an outer lip of the gutter and a space between room shingles.

In embodiments, the plural gutter screens in the vicinity of roof valley 16 may include three gutter screens 30 with two having a length of approximately 11 inches and a width of approximately 12 inches as shown in FIG. 3, and a third screen 30A sandwiched there between, and bridging roof valley 16 as shown in FIG. 1. It has been found that screen dimensions significantly smaller or larger than as defined above do not reach, or over-reach shingles or tiles in the majority of roof constructions or do not wedge properly between such roofing elements. The dimensions and positioning of screens 30 as shown in FIG. 3 enables a fit on roof valley area 16 in a superior manner whereas screen dimensions significantly smaller or larger than stated do not reach, or over-reach shingles or tiles in the majority of roof constructions or do not wedge properly between such roofing elements.

In embodiments, the rain catching and screening assembly 15 may have the screening layer 18 positioned over the mesh layer 37 and together may be approximately 3/32 inches in thickness wherein a thicker assembly is too disruptive to roofing elements such as shingles and tiles when the edge 32 of the assembly is wedged between the roofing elements.

In embodiments, the screening layer 38 may have between 30 and 60 wire strands of 5.5 mils (thousandths) diameter per inch, warp and weft, providing an approximately 60% opening overall. Significantly greater wire density does not permit water flow-through at a necessary rate causing run-off water to have an undesirable cascade effect bypassing the gutter 22, 24 during periods of heavy rain. Significantly lesser wire density has been found to permit small objects, such as pine needles, to pass through the screening layer 38 to thereby enter the gutter 22, 24 contributing to gutter and downspout fouling. The screening layer structure defined above has been found through an evolutionary set of steps improving up to the present time. All screening materials are a compromise depending on weather conditions and especially the supporting underlayment, in this case, mesh layer 37, but gutter/screening installation contractors do not have the luxury of making fine-tuned changes from one installation to the next down the block or in the next town primarily because materials must be purchased in bulk quantities in order to enable competitive job pricing. Therefore, it is of great value and important to arrive at a compromise arrangement that is near optimal for all customers and this achievement is of importance commercially, economically, and practically. Applicant believes that the described apparatus and its attachment methodology would not be obvious to those in this art given the known prior art and to achieve the results which are herein defined would require considerable experimentation under real-world conditions.

The mesh layer may be of an expanded or perforated metal sheet having openings therein of approximately 7/16"×1/4" which provides an approximately 75% opening overall which is adequate to pass about 90% of the screening layer water throughput through the mesh layer 37. It has been found that a mesh layer 37 with openings significantly larger than 75% typically does not permit adequate rigidity, and with smaller openings does not permit adequate water throughput. In some roofing installations the gutter screens do not lie directly on the roof surface so that it is necessary to have enough structural rigidity underlying the fine screening 38 to maintain planarity when wet even when supported only at opposing edges. It is clear that a stronger material may be used for mesh layer 37, but this raises the issue of material thickness and wedging efficacy, and of material cost. The present mesh layer 37 is produced from aluminum sheet rolled to the desired thickness and then annealed for an appropriate stiffness. A less expensive sheet material with the necessary physical properties has been sought but not found to date.

Embodiments of the subject apparatus and methods have been described herein. Nevertheless, it will be understood that modifications by those of skill in the art may be made without departing from the spirit and understanding of this disclosure. Accordingly, other embodiments and approaches are within the scope of the following claims.

What is claimed is:

1. In a peaked roof building having adjoining roof portions, said portions meeting at an approximate right angle thereby forming a concave V-shaped roof valley, a rain catching and screening assembly comprising:

a rain gutter for attachment to the building along a roof line thereof, the rain gutter having an approximate right angle between a first and a second gutter portions, the gutter portions joined at a position in line with the roof valley, wherein the gutter portions have a generally U-shaped cross section shape defining an outer gutter leg terminating at an outer gutter lip, and an inner gutter leg terminating at an inner gutter lip, the inner gutter leg enabled for being fastened to the building approximately parallel to and under the roof line;

plural rectangular gutter screens, each one of said screens having a peripheral edge, a top surface, a bottom surface, a structural mesh layer and a fine screening layer, the screens arranged in side-by-side positions overcasting the rain gutter and a portion of the roof portions, the peripheral edge of said screens fastened to the outer gutter lip of the rain gutter, and being wedged between roofing materials of the roof portions;

one of said gutter screens positioned for being placed over the two adjoining roof portions, the one said gutter screen having a V-shaped crease in the mesh layer and fine screening layer thereby being adapted for lying in contact with the adjoining roof portions in alignment with the V-shaped roof valley.

2. A peaked roof building with a rain catching and screening assembly comprising:

adjoining roof portions, said portions meeting at an approximate right angle thereby forming a concave V-shaped roof valley;

a rain catching and screening assembly including a rain gutter and plural gutter screens;

the rain gutter attached to the building along a roof line thereof, the rain gutter having an approximate right angle between a first and a second gutter portions, the gutter portions joined at a position in line with the roof valley, the gutter portions having a generally U-shaped cross section shape defining an outer gutter leg terminating at an outer gutter lip, and an inner gutter leg terminating at an inner gutter lip, the inner gutter leg fastened to the building approximately parallel to and under the roof line;

the gutter screens, each having a peripheral edge, a top surface, a bottom surface, a structural mesh layer and a fine screening layer, the screens arranged in side-by-side positions overcasting the rain gutter and a portion of the roof portions, the peripheral edge of said screens fastened to the outer gutter lip of the rain gutter, and wedged between roofing materials of the roof portions;

one of said gutter screens positioned over the two adjoining roof portions, the one said gutter screen having a V-shaped crease in the mesh layer and fine screening layer thereby lying in contact with the adjoining roof portions in alignment with the V-shaped roof valley.

3. The rain catching and screening assembly of claim 2 wherein the plural gutter screens include at least two gutter screens, wherein one of the two screens has a length of approximately 21 inches and a width of approximately 12 inches and a further one of the gutter screens has a length of approximately 11 inches and a width of approximately 12 inches.

4. The rain catching and screening assembly of claim 2 wherein the plural gutter screens include at least three gutter screens each having a length of approximately 11 inches and a width of approximately 12 inches.

5. The rain catching and screening assembly of claim 2 wherein the screening layer is positioned on top of the mesh layer and together are approximately 3/32" in thickness.

6. The rain catching and screening assembly of claim 2 wherein the screening layer has between 30 and 60 strands of 5.5 mils diameter per inch, warp and weft, providing an approximately 60% opening overall.

7. The rain catching and screening assembly of claim 2 wherein the mesh layer is of an expanded or perforated metal sheet having openings therein of approximately 7/16"×1/4" providing an approximately 75% opening overall.

8. The rain catching and screening assembly of claim 7 wherein the mesh layer is of a rolled and annealed aluminum sheet alloy.

9. The rain catching and screening assembly of claim 2 wherein the gutter screens have a flexural strength sufficient to maintain a planar posture when supported only at opposing edges of the peripheral edge.

* * * * *